United States Patent [19]

MacFarlane et al.

[11] Patent Number: 4,872,516

[45] Date of Patent: Oct. 10, 1989

[54] AIR DRIVEN IMPACT OPERATED GROUND PIERCING TOOL

[75] Inventors: Ronald L. MacFarlane, Buffalo Grove, Ill.; Dirk A. Wilson, Milwaukee, Wis.

[73] Assignee: Oklahoma Airrow, Inc., Perry, Okla.

[21] Appl. No.: 188,354

[22] Filed: Apr. 29, 1988

Related U.S. Application Data

[63] Continuation of Ser. No. 802,600, Nov. 27, 1985, abandoned.

[51] Int. Cl.[4] ..... B23B 45/16

[52] U.S. Cl. ..... 173/134; 173/139

[58] Field of Search ..... 173/90, 91, 116, 137, 173/139, 134, 135

[56] References Cited

U.S. PATENT DOCUMENTS

| | | | |
|---|---|---|---|
| 3,137,483 | 6/1964 | Zinkiewicz . | |
| 3,410,354 | 11/1968 | Sudnishnikov et al. . | |
| 3,474,873 | 10/1969 | Zygmunt . | |
| 3,511,137 | 5/1970 | Smith | 173/139 X |
| 3,616,865 | 11/1971 | Sudnishnikov et al. . | |
| 3,685,597 | 8/1972 | Kostylev et al. . | |
| 3,705,633 | 12/1972 | Sudnishnikov et al. . | |
| 3,708,023 | 1/1973 | Nazarov et al. . | |
| 3,727,701 | 4/1973 | Sudnishnikov et al. . | |
| 3,744,576 | 7/1973 | Sudnishnikov et al. . | |
| 3,756,328 | 9/1973 | Sudnishnikov et al. . | |
| 3,763,939 | 10/1973 | Sudnishnikov et al. . | |
| 3,941,101 | 3/1976 | Kosteylev et al. . | |
| 3,952,813 | 4/1976 | Chepurnoi et al. . | |
| 3,995,702 | 12/1976 | Klimashko et al. . | |
| 4,070,948 | 1/1978 | Tkach et al. . | |
| 4,078,619 | 3/1978 | Sudnishnikov et al. . | |
| 4,114,700 | 9/1978 | Tkach et al. . | |
| 4,121,672 | 10/1978 | Tkach et al. . | |
| 4,132,277 | 1/1979 | Tupitsyn et al. . | |
| 4,171,727 | 10/1979 | Tkach et al. | 173/91 X |
| 4,214,638 | 7/1980 | Sudnishnikov et al. . | |
| 4,284,147 | 8/1981 | Jenne . | |
| 4,570,723 | 2/1986 | Kostylev et al. . | |

FOREIGN PATENT DOCUMENTS

| | | |
|---|---|---|
| 1294891 | 5/1969 | Fed. Rep. of Germany . |
| 8026456 | 10/1980 | Fed. Rep. of Germany . |
| 2634066 | 9/1984 | Fed. Rep. of Germany . |
| 126446 | 4/1960 | U.S.S.R. . |
| 338362 | 5/1972 | U.S.S.R. . |
| 392215 | 1/1974 | U.S.S.R. . |
| 800725 | 9/1958 | United Kingdom . |
| 1170167 | 11/1969 | United Kingdom . |

OTHER PUBLICATIONS

Grundomat brochure.
Essig brochure.
Pierce Airrow brochure.

*Primary Examiner*—Frank T. Yost
*Assistant Examiner*—Willmon Fridie, Jr.
*Attorney, Agent, or Firm*—Foley & Lardner

[57] ABSTRACT

An improved air-driven ground impact borer including an air valve assembly constructed of a flexible, high-lubricity plastic material such as phenolic-impregnated linen; and a reciprocal striker including, on its posterior end, a sealing bearing in the form of a split ring made of a long-wearing, resilient, high-lubricity material such as oil-filled nylon and, on its anterior end, two or more spot bearings of relatively small surface area and made of a long-wearing, resilient, high-lubricity material such as oil-filled nylon.

9 Claims, 2 Drawing Sheets

AIR DRIVEN IMPACT OPERATED GROUND PIERCING TOOL

This is a continuation of application Ser. No. 802,600 filed on Nov. 27, 1985, now abandoned.

FIELD OF THE INVENTION

This invention relates to air driven, impact operated ground piercing tools, and is more particularly concerned with improvements in such a ground borer whereby its efficiency, power, speed of operation and reliability are increased.

BACKGROUND OF THE INVENTION

An impact operated ground piercing tool of the general type to which this invention relates is disclosed in U.S. Pat. No. 3,756,328 to Sudnishnikov et al. Such a tool comprises, in general, a sturdy elongated housing, a piston-like striker reciprocable back and forth in the housing, and an air valve coaxially supported in the rear end portion of the housing and to the rear of which a compressed air hose is connectable. The rear portion of the striker is formed as a tubular wall that defines a coaxial rearwardly opening well in which a sleeve formed by an enlarged diameter front end portion of the air valve is received with a close sliding fit, so that the sleeve and the rear portion of the striker cooperate to define a variable volume inner chamber.

Pressure air from the hose, conducted into the inner chamber by way of the air valve, drives the striker forward into percussive engagement against a rearwardly facing anvil surface in the front end portion of the housing, and the momentum produced by this impact drives the housing forward in the ground.

As the striker nears the front of its stroke, radially opening ports through its tubular wall portion pass the front edge of the sleeve, and are thus uncovered, so that pressure air can flow out of the inner chamber and into an outer chamber jointly defined by the inside of the housing and the outside of the striker. Pressure air in this outer chamber acts upon the entire cross-sectional area of the striker to exert a force that propels the striker rearward until the ports in it are behind the sleeve, whereupon pressure air from the outer chamber is exhausted to the atmosphere through the ports in the striker by way of rearwardly opening outlet passages in the housing that are external to the sleeve.

The air valve must be concentrically supported in the rear portion of the housing, to be in concentric relation to the reciprocating striker. Because of the high acceleration of the housing at each advance and the inertia forces that tend to retard the air valve and the hose that is attached to it, high forces have to be transmitted through the connection between the housing and the air valve, and therefore a rigid connection between them, unless it is adequately strong and heavy, can break after a relatively short period of operation. Thus a yielding shock dampening connection between the housing and the air valve in conjunction with a certain amount of flexibility in the sleeve of the air valve is more likely to have a long useful life than a rigid connection.

It is evident that the junctures between the rear portion of the striker and the inner wall of the housing and between the sleeve and the inner wall of the rearwardly opening well of the striker must be simultaneously freely-slidable and well-sealed against air leakage through the juncture. In practice, obtaining optimal sliding freedom and sealing has been extremely difficult. This is especially so in tools which utilize only metal-to-metal contact at these crucial junctures.

Typical of such metal-to-metal tools is the tool described in Sudnishnikov U.S. Pat. No. 3,756,328 referred to earlier. In such tools, adequate freedom to slide at the crucial junctures can only be accomplished by adopting a clearance fit between the parts at the juncture. Typically, those clearances are on the order of 0.015 of an inch. If the clearances are increased, air sealing and tool efficiency suffer. If the clearances are decreased, sliding friction goes up and tool efficiency suffers.

The need for carefully controlled metal-to-metal fit at the crucial junctures in prior art tools increases demand on manufacturing quality control and assembly. Further, because ground borers operate in a very wide range of hostile environments and temperatures and with varying and unpredictable degrees of field maintenance, clearances at the crucial junctures can vary unpredictably in the field. Further, in operation, the tools often strike rocks, tree roots and other obstructions, thereby, distorting the housing of the borer and slowing down or possibly jamming the striker against the close-fitting inner wall of the housing or against the sleeve of the air valve. The result is erratic tool operation and earlier than expected tool failure. Further, if the tool jams in operation, it often must be excavated out or abandoned at a potential cost of thousands of dollars.

Applicant has discovered that increased tool speed, efficiency, power, and reliability can be achieved at one of the crucial junctures by the use of spot bearings and a sealing bearing of low surface area on the anterior and posterior portions of the striker. These improvements reduce sliding friction between the striker and the housing and heighten air pressure retention in the outer chamber during rearward motion of the striker. While earlier tools such as the Accupunch made by Tracto Technik, Lennestadt, West Germany and the Terra Hammer made by Terra AG, Mullerweg, West Germany have attempted to use antifriction and sealing materials on their strikers, none has done so with the simplicity, efficiency and high reliability afforded by applicant's invention.

Additionally, applicant has discovered that a sizable reduction in sliding friction with enhanced sealing can be achieved at the other crucial juncture, (i.e., between the sleeve and the interior of the striker wall) by constructing the sleeve of the air valve of a flexible plastic material from a group which has good antifriction properties and by use of the bearing land configuration of applicant's design. By use of such a sleeve, useful reduction in sliding friction between the sleeve and the striker inner wall is effected as well as improved air sealing between the striker and the sleeve. Heightened tool efficiency and reliability are thus achieved.

Further, applicant has discovered that additional flexibility in the sleeve itself can provide significant reduction in the effect of shock and flexure on the tool. While certain earlier tools, including the one described in Sudnishnikov, et al. U.S. Pat. No. 3,410,354 and the tool known as the Ground Bullet made by Lewin Engineering Co., Mound, Minn., have utilized a rubber or plastic hose to replace the posterior portion of the sleeve and to connect the sleeve to the air inlet pipe, applicant has discovered that the entire sleeve may advantageously be made of a flexible plastic material. Shock and the effects of side-to-side pressure of the air inlet hose on the air inlet pipe are reduced by such a structure.

Further, applicant has discovered that even greater reliability can be achieved by using a flexible plastic sleeve in conjunction with an elastomeric shock dampener.

Applicant has further discovered that the invention described herein is essentially a necessity when the tools are made in small diameters of less than about 3 inches. In small diameter tools, the amount of room in the posterior end of the tool becomes less and less until the shock dampening coupling becomes so firm that its ability to flex is reduced to the point where it is only marginally adequate to deal with the shock and pressure of tool operation in the field and a flexible sleeve is a practical necessity.

SUMMARY OF THE INVENTION

The general object of the present invention is to provide an impact operated ground borer that is simple in construction and correspondingly low in cost but is nevertheless capable of substantially better performance with substantially better reliability than impact operated borers heretofore available, and in particular, better resistance to shock and flexure, improved internal sealing and reduced internal friction.

Another and more specific object of this invention is to provide an impact operated earth borer that comprises an outer housing body, a piston-like striker axially movable in the housing body, and an air valve, including a sleeve, to which a pressure air supply hose is connectable, said air valve having a connection with the housing body which is threaded to provide for reversal of the direction of propulsion of the borer by rotation of the air valve and which connection comprises a resilient shock dampener in conjunction with a flexible sleeve permitting the sleeve to have limited yielding axial movement relative to the housing body, said borer being so arranged as to permit substantially unrestricted inflow of pressure air from the sleeve into the interior of the housing body and also to provide exhaust air outlet passages. Said sleeve being made of a stable, flexible plastic material and fitted with bearing lands to provide improved resilience to shock and flexure and improved sealing between the sleeve and the striker.

Another and very important object of this invention is to provide simple and inexpensive improvements in friction reduction and sealing in an impact operated earth boring tool of the character described whereby both the reliability and the consistency of operation of the device are greatly improved without sacrifice or compromise with the requirements for sturdiness and structural simplicity.

It is also an object of the invention to provide a ground boring tool of the character described that is comprised of a relatively small number of parts, all of them simple, very sturdy and relatively inexpensive, cooperating to provide a high performance tool that is very reliable through a long service life.

BRIEF DESCRIPTION OF DRAWINGS

In the accompanying drawings, which illustrate what is now regarded as a preferred embodiment of the invention.

DETAILED DESCRIPTION OF PREFERRED EMBODIMENT OF THE INVENTION

Figure 1:
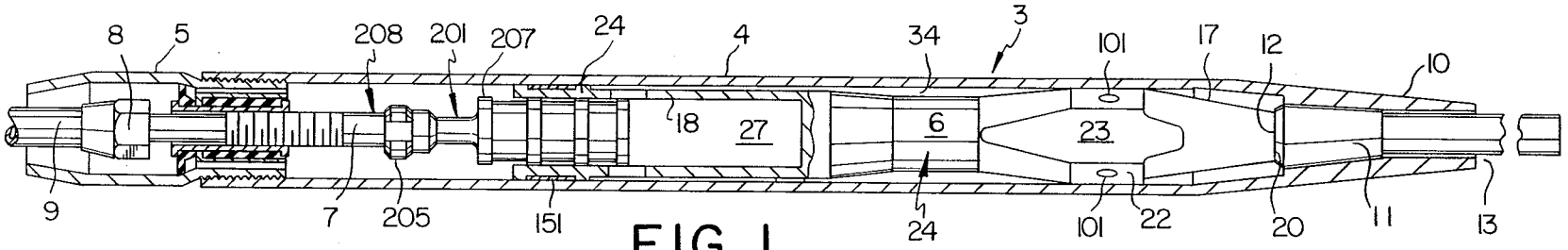
FIG. 1 is a view of the borer in longitudinal section.

An impact operated earth borer of this invention comprises, in general, an elongated hollow housing 3 that consists of a main body 4 and a coaxial tailpiece 5, a piston-like striker 6 that reciprocates lengthwise in the housing 3, and a two part air valve (inlet) 208 comprising a threaded metal air inlet pipe 7 connected to plastic sleeve 201. These are connected to the rear inlet pipe 7 by coupling 8 for hose 9 whereby pressurized fluid is supplied to the borer. The hose 9 will usually be connected with a source (not shown) of compressed air.

The exterior surface of the housing body 4 defines a nose portion 10 which can taper forwardly to a blunt or a pointed front end, depending upon the nature of the ground in which the borer is to operate, but along most of its length the housing body is cylindrical and has a uniform outside diameter as well as a uniform inside diameter. In the interior of the housing body 4, at its front, there is provided as part of housing body 4 an anvil 11 that provides a rearwardly facing impact surface 12 which is percussively engaged, during forward operation of the borer, by the front end of the striker 6. The anvil 11 can be specially hardened and its front end portion can project beyond the body proper, as at 13, to provide a front end portion of the housing. In its rear end portion the housing body has an internal thread 14 that provides for connection of the tailpiece 5.

Figure 5:
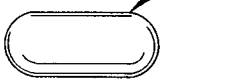
FIG. 5 is an overhead view of an alternative configuration of spot bearing.
Figure 4:
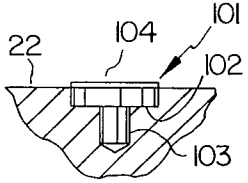
FIG. 4 is a view of the spot bearing member in place in the striker, in transervse section.
Figure 3:
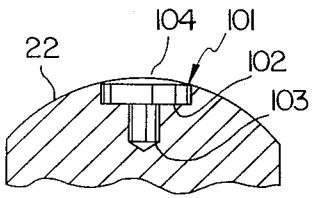
FIG. 3 is a view of the spot bearing member in place in the striker, in longitudinal section.

The piston-like striker 6, which is long enough to extend through a major portion of the hollow interior of the housing body 4, is solid along most of its length but has in its front portion an axial, coaxial taper, so that its front portion of the striker tapers frustoconically, as at 17, to a forwardly facing impacting surface 20 that engages the impact surface 12 on the anvil 11. On the solid front portion of the striker, behind its tapered nose portion 17 and extending along an axially short, rounded guiding portion, the striker has a diameter such as to have a close, sliding fit in the housing body 4; but there are circumferentially spaced flats 23 in this guiding portion that define passages through which air can flow forwardly and rearwardly between the striker and the housing body and divide the guiding portion into a series of spaced apart rounded guiding zones 22. Oil-filled nylon spot bearings 101 are set into each guiding zone 22 to support the striker 6 in the interior of the housing 3 and reduce sliding friction. Spot bearing 101 is also shown in FIGS. 3 and 4. FIG. 5 shows an alternative elongated or "breadloaf" configuration 105 for the spot bearing.

Figure 6:
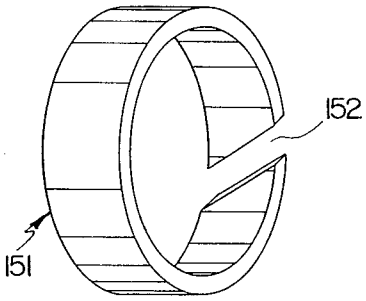
FIG. 6 is a view of the sealing bearing.

From the guiding zone 22 nearly to its rear end the striker 6 has an outside diameter which is substantially smaller than the inside diameter of the housing body. However, the rear end portion 24 of the striker has an enlarged diameter to have a sliding fit in the housing body that is close enough to provide an air seal and to reduce sliding friction, a sealing bearing 151 is fitted into an annular groove in the rear end portion 24 of the striker 6. The sealing bearing 151 is also shown in FIG. 6.

Figure 7:
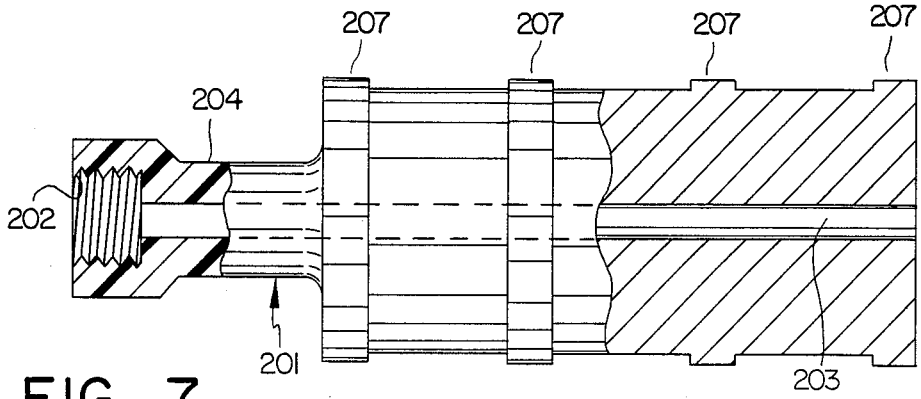
FIG. 7 is a view of the sleeve.

The sleeve 201 of air inlet 208 has a coaxial bore 203 extending through its entire length. The sleeve 201 has a front portion 206 of enlarged diameter to have a close slidable and substantially sealing fit in the tubular wall 18 that comprises the rear end portion of the striker 6 and defines a rearwardly opening, coaxial recess therein. To reduce friction while insuring a close fit, the sleeve 201 is made of a tough, low friction plastic material and fitted with annular bearing lands 207 which encircle the enlarged front portion 206 of the sleeve 201. The sleeve 201 is also shown in FIG. 7. Sleeve 201 is connected to threaded inlet tube 7 by a rear coupling portion 202 which is in turn connected to front portion 206 by a narrow neck 204. As shown, in FIG. 7, front portion 206 has a greater diameter than coupling portion 202, and coupling portion 202 has a greater diameter than neck 204.

The sleeve 201 and the striker 6 thus cooperate to define a variable volume inner chamber 27 into which pressurized air from the hose 9 issues forwardly through the sleeve and wherein such air exerts a force on the striker that propels it forward into percussive engagement with the anvil 11 in the housing body to drive the tool forward.

The striker 6 has radially opening ports 28 in its tubular wall portion 18, located just forward of its enlarged diameter rear end portion 24. During a substantial portion of the forward movement of the striker these ports 28 are blocked by the sleeve, but in the final stage of that movement the ports 28 pass forwardly beyond the front end of the sleeve to allow pressure air to escape from the inner chamber 27 into an outer variable volume chamber 34 which is defined by the housing body 4 in cooperation with all of that part of the striker 6 that is forward of its enlarged diameter rear end portion 24. Pressure air in the outer chamber 34, acting upon the whole cross-section area of the striker, then exerts upon it a rearward force which is greater than the forward force exerted by pressure air in the inner chamber 27, and therefore the striker is driven rearward. Near the end of the rearward stroke the ports 28 in the striker travel behind the rear edge of enlarged portion 206 of the sleeve 201, permitting pressure air in the outer chamber 34 to flow radially inwardly through them and to pass out of the housing, externally of the sleeve 7, through exhaust passages 30 in the tailpiece 5. Together, inner chamber 27, ports 28, outer chamber 34, and exhaust passages 30 provide passages which cooperate with sleeve 201 of inlet 208 to define a valve which causes reciprocation of striker 6.

The tailpiece 5, which is preferably in one piece, can be considered to have a front connecting portion 31 and a coaxial rear portion 32 that provides a protective housing for the coupling 8 that connects the hose 9 to the air inlet pipe 7.

The external surface of the tailpiece rear portion 32 is more or less frustoconical and rearwardly tapering to facilitate rearward movement of the borer out of a hole should that be necessary. The interior of the rear portion 32, which constitutes a rearwardly opening cavity, accommodates the hose coupling 8 with substantial clearance.

The front portion 31 of the tailpiece, which has a smaller outside diameter than its rear portion 32, has a relatively thick tubular wall with a cylindrical inner surface 33 and is externally threaded for attachment to the internal thread 14 in the housing body. The exhaust passages 30 extend axially through the tubular wall of this front portion 31 of the tailpiece to open into the hollow interior of its rear portion 32. The cylindrical inner surface 33 of the front portion 31 of the tailpiece closely surrounds an imperforate annular shock dampener 35 of elastomeric material which has concentric radially inner and outer cylindrical surfaces and has flat and parallel front and rear end surfaces. The rear end of the shock dampener 35 abuts against a radially inwardly projecting circumferential flange 36 on the tailpiece.

Extending coaxially through the shock dampener 35 is a substantially tubular bushing 38 that is internally threaded and has a radially outwardly projecting circumferential flange 39 at its front end. The shock dampener is axially confined between the flanges 36 and 39, on the tailpiece and on the bushing, respectively, and is closely confined radially between the tailpiece 5 and the bushing 38. Bushing 38, shock dampener 35, and front portion 31 of tailpiece 5 together provide a support assembly that maintains air inlet 208 substantially concentric to housing 3.

Figure 2:
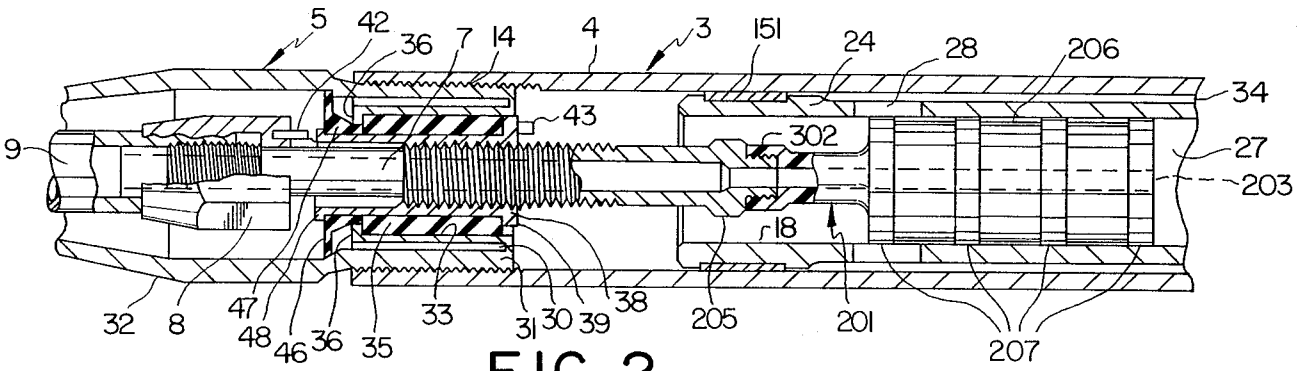
FIG. 2 is a view in longitudinal section of the rear portion of the borer, on a larger scale than FIG. 1.

Attached to sleeve 201 by threaded fitting 202 is external threaded air inlet pipe 7 that mates with the internal threads in the bushing 38, so that rotation of the pipe 7 moves it longitudinally between a forward operating position (in which it is shown in FIGS. 1 and 2) and a more rearward reverse operating position. The pipe 7 can be rotated by means of the hose 9, which has a rotation transmitting connection to sleeve 201 when the coupling 8 is secured. The limits of motion of sleeve 201 relative to the bushing 38 are controlled by radially projecting lugs 205 on pipe 7 and radially projecting lug 42 on hose nut 8 that engage front and rear axially projecting lugs 43, 44 hose on bushing 38.

FIGS. 1 and 2 show the tool with sleeve 201 positioned for forward operation. When the sleeve 201 is in its reverse operating position, it is spaced some distance to the rear of the position shown. During forward movement of the striker 6, the ports 28 in the striker are therefore uncovered while the striker is still a substantial distance from engagement with the anvil 11, so that the striker does not impact the anvil, or impacts it only lightly; but when the striker moves rearward, its ports 28 do not pass the sleeve, to communicate the outer variable volume chamber 34 with the exhaust passages 30, until just before the rear end of the striker impacts the front end of the tailpiece 5 and thus imparts a rearward impetus to the housing.

Pressure air is substantially completely exhausted from the housing 3 during rearward movement of the striker, and some air should be allowed to flow forward through the exhaust passages 30 during its forward stroke, so that the striker does not have to be driven against a vacuum. A resilient annular flapper valve 46 prevents dirt from being drawn forwardly into the exhaust passages but does not interfere with rearward flow of exhaust air out of them. The flapper valve 46 is made of rubber or rubber-like material and can be molded in one piece. It has a frustoconical forwardly tapering hub-like portion 47 that closely surrounds the bushing 38 and is axially confined between the shock dampener 35 and a radially outwardly projecting circumferential flange 48 on the rear end of the bushing.

Projecting radially outwardly from this hub portion 47 is a disc-like portion which comprises the valve proper.

Since the shock dampener 35 should fit closely around the bushing 38 and cannot be very soft, it cannot be passed axially over either of front and rear flanges 39 and 48 on bushing 38. The shock dampener is therefore slit axially along its length and, spread apart at the slit, it is installed laterally onto the bushing. The radially inner and radially outer surfaces of the shock dampener, as well as the axially extending surfaces defined by the slit, are coated with a quick drying cement to secure the shock dampener to both the tailpiece 5 and the bushing 38 and thus prevent the latter from turning when the pipe 7 is rotated for reversing the direction of operation of the tool.

With the foregoing explanation of the general construction and principles of operation of the borer, attention can now be given to certain features that account for the superior performance of the tool of this invention.

In such tools, it is evident that reduction of internal friction and increase of air sealing result in improved tool performance in speed and efficiency. Achieving these goals simultaneously is difficult and many different attempts have been made by manufacturers and designers of impact operated ground piercing tools. The more pertinent of these are discussed below. However, none of these previous efforts have resulted in the simplicity, effectiveness and reliability of the applicant's invention, as has been borne out in tests.

Applicant has discovered that a sealing bearing means, such as sealing bearing 151 of FIG. 6, made of an oil filled nylon and configured as a split ring by diagonal cut 152 is able to simultaneously reduce sliding friction between the striker 6 and the inner surface of housing 3 to improve air sealing between the rear portion 24 of the striker 6 and the inner surface of the housing 3 with excellent reliability. This results in improved tool performance and reliability above that of tools which employ no seals or bearings at this crucial juncture (other than metal-to-metal clearance) or which employ high friction, low reliability elastomeric O-rings such as the Terra Hammer made by Terra AG, Mullerweg, West Germany.

Figure 9:
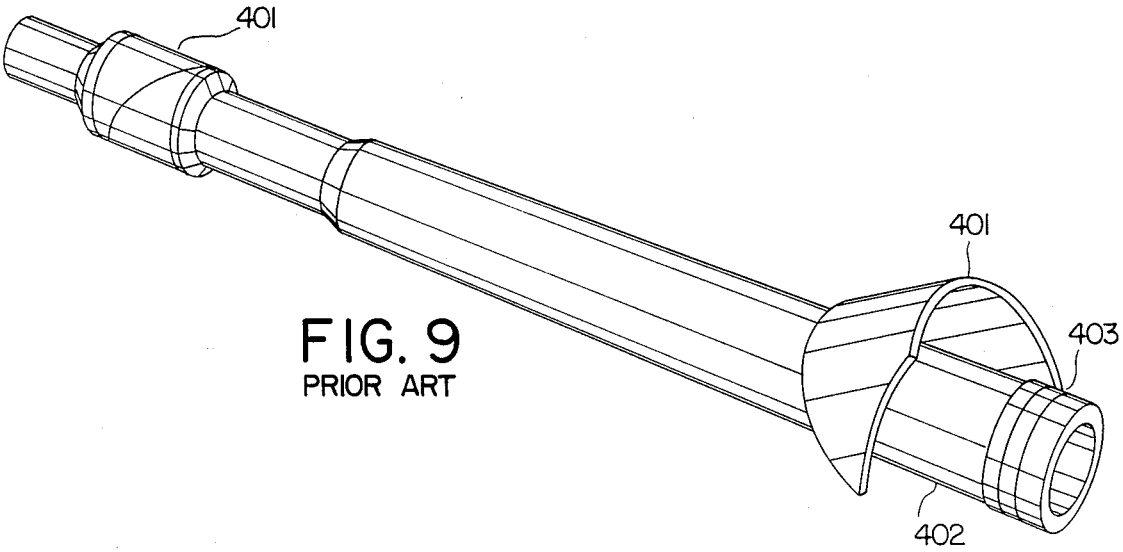
FIG. 9 PRIOR ART
FIG. 9 is a view of the striker of the prior art Accupunch tool.

Applicant has also discovered that sealing bearings made of oil-filled nylon work well at bearing lengths on the order of 1–2 cms. This short bearing length greatly reduces sliding friction as compared to tools which utilize long teflon sleeves in conjunction with a teflon split bearing such as the Accupunch tool made by Tracto Technick, Lennestadt, West Germany. FIG. 9 is a drawing of the striker of the Accupunch tool. Long split teflon sleeves 401 are used at the anterior and posterior ends of the striker in conjunction with posterior teflon split ring bearing. Applicant has discovered that in practice the prior art long teflon sleeves fail relatively early. This appears to be due to the longitudinal flexibility of the relatively thin teflon sheet used to form the sleeves. This results in the sleeves "working" themselves out of their grooves 402 during tool operation. Erosion of the sleeve edges results as does the possibility of tool jamming if the sleeve becomes wedged between the exterior of the striker and the inner wall of the housing.

Teflon split bearing 403 of the Accupunch prior art is superficially like applicant's oil-filled nylon sealing bearing. However, applicant has discovered that by proper choice of material (i.e., oil-filled nylon) and sealing bearing configuration (as discussed below), the long sleeve bushing of the prior art may be dispensed with altogether with commensurate reduction in complexity, cost, maintenance cost, and sliding friction with improved tool speed, power and reliability.

Applicant has discovered that the sealing bearing of the type disclosed here is best made with external diameter slightly in excess of the external diameter of the rear portion 24 of striker 6. The diagonal cut 152 is then made slightly greater than the difference between the external diameter of the sealing ring 151 and the external diameter of the rear portion 24 of the striker 6. The resultant sealing bearing is then kept in sealing contact with the inner wall of housing 3 by the natural resilience of the oil-filled nylon material insuring sealing even under varying temperature circumstances and when wear of the inner wall of the housing has resulted from the hostile working environment of the tool or from poor field maintenance. The resilience of the sealing bearing permits increased clearance to be used between the rear portion 24 of striker 6 and the inner wall of housing 3, without negatively affecting air sealing. In practice, this helps to prevent tool slow-down or jamming due to eccentricity of the bore of housing 3 caused by manufacturing irregularity or from distortion in the tool housing caused by the tool striking a rock or other obstruction during operation.

In practice, applicant has had good success with a cast oil-filled nylon characterized by

| | |
|---|---|
| Specific Gravity | approx. 1.13 |
| Water Absorption (24 hrs at 73° F.) | approx. 0.55% |
| Melting Point | approx. 220° C. |
| Coefficient of linear expansion 68–140° F. | approx. $44 \times 10^{-6}$ in/in/F.° |
| Tensile strength at yield | approx. $10 \times 10^{3}$ psi |
| Limited flexural strength | approx. 17 psi |
| Hardness Rockwell M | approx. 80 |

One suitable material is Ertalon LFX made by Erta, Inc., Malvern, N.J.

Applicant has further discovered that a ground piercing tool with marked reduction in internal friction may be accomplished with spot bearings 101 in the form of circular bearings with slightly crowned upper surfaces set into appropriate circular recesses in the guide zone 22 of the striker 6. Tools employing such spot bearings function extremely well. The applicant has discovered that a tight, force-fit between such a bearing in the recess 102 in the striker is adequate to hold it in place if combined with projection 103 associated with the base of the spot bearing. This projection 103 resides in a further recess in the body of guide zone 22 of striker 6. It is believed that the projection 103 provides additional resistance to shear forces operating on the spot bearing during operation, helping to keep it in place during the operation of the tool. The spot bearing of applicant's invention is shown in FIGS. 3 and 4.

The applicant has further discovered that the crowned upper surface of the bearing should be machined to the radius of the guide zone 22 of striker 6 to insure maximum contact surface.

Applicant has also discovered that, in appropriate circumstances, when greater bearing surface is desired, the spot bearing may be configured in an elongated or "breadloaf" shape rather than round. Such breadloaf shape is shown in FIG. 5. Alternatively, additional round spot bearings may be set into the guide zone of the striker in longitudinal relation to one another, thereby affording additional bearing surface if needed.

The applicant has also discovered that by utilizing such spot bearings, a marked increase in clearance between the guide zones 22 of striker 6 and the tubular inner wall of housing 3 can be achieved with ease. In this instance, location of the forward end striker in the interior of housing 3 is effected by the spot bearings alone. In order to survive in such an environment, the spot bearings need to be made of a durable high lubricity material. The applicant has discovered that oil-filled nylons of the same type as are appropriate for use in sealing bearings are also appropriate for this purpose. One such satisfactory nylon material is Ertalon LFX, manufactured by Erta, Inc., Malvern, N.J.

Applicant has determined that the spot bearings of this invention result in markedly decreased sliding friction in the tool. This is contrasted with the long teflon bearing utilized by the prior art Accupunch tool as shown in FIG. 9. Particularly, because oil-filled nylon is capable of some compression, it is possible to fit a striker equipped with the spot bearings of applicant's invention so that the spot bearings are under some compression. Friction is still low and the natural resilience of the oil-filled nylon material permits the spot bearing to expand and contract in response to irregularities in the inner wall of the housing 3 and thus to compensate for wear or distortion in the inner wall of the housing.

As is apparent, the oil-filled nylon sealing bearing and the oil-filled nylon spot bearing offer the prospect of field overhaul of the striker which is not possible in an all-metal striker. Because bearing surfaces utilizing applicant's invention are both long-lasting and field replaceable, notable improvement in operating economy can be achieved.

Applicant has also discovered that considerable reductions in internal friction, improvements in air sealing and improved resistance to shock impact may be achieved by forming the sleeve 201 of a flexible plastic material as opposed to the machined steel common in the prior art.

Applicant has also discovered that an appropriate plastic material is phenolic-impregnated linen such as Linen LV distributed by The Lake Country Corporation of Northlake, Wisc. This material is characterized by

| | |
|---|---|
| Density | approx. 1.3 |
| Continuous operating temperature | approx. 250° F. |
| Moisture absorption | approx. 1% |
| Rockwell M hardness | approx. 105 |
| Tensile strength in flexure | approx. 16,000 psi |

A sleeve constructed of such material flexes in a limited fashion in response to flexure by hose 9 transmitted through inlet pipe 7 into sleeve 201. Pipe 7 is mounted in a flexible mount formed by shock dampener 35. The combination of the flexibility and shock-dampening qualities of shock dampener 35 with the beneficial flexibility of the phenolic-impregnated linen sleeve 201 results in a tool which has a high resistance to damage from flexure and shock. This is believed to result from two aspects of such a tool. The first of these is that the combined flexibility of shock dampener 35 and the material of sleeve 201 is more effective than reliance upon the shock dampening characteristics of dampener 35 alone. This is especially true in small diameter tools where, of necessity, dampener 35 becomes thin and relatively rigid. In addition, applicant believes that by utilizing members of two distinct materials, namely the steel of pipe 7 and the phenolic-impregnated linen of sleeve 201, vibrational periods in wave forms resulting from the shock and vibration of tool operation are broken up and do not have an opportunity to build in intensity within the structure of the air valve 208 comprising the steel pipe 7 and plastic sleeve 201. This is in contradistinction to all metal air valve systems which are common in the prior art (e.g., Sudnishnikov, U.S. Pat. No. 3,756,328.) In these systems the air valve is entirely made of steel and standing waves and other vibrational amplifications are possible within the structure of the air valve, even though those tools utilize a rubber dampener (e.g., the Hole Hog distributed by Allied Steel & Tractor Products, Inc. of Cleveland, Ohio).

Figure 8:
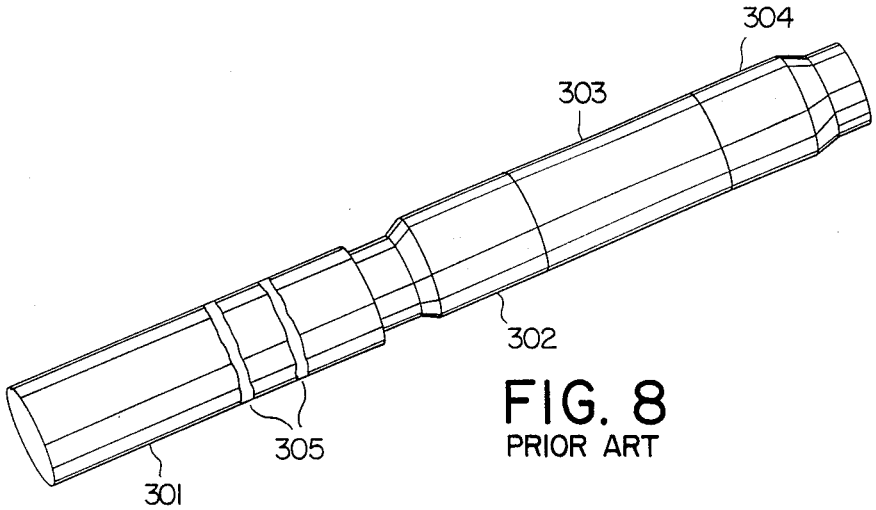
FIG. 8 PRIOR ART
FIG. 8 is a view of the air valve and sleeve of the prior art tool made by Lewin Engineering Company.

Workers in the prior art have recognized the potential advisability of increased flexibility in the air valve structure of impact ground borers. Two such are Sudnishnikov, et al. U.S. Pat. Nos. 3,410,354 and Sudnishnikov, et al. 4,078,619 each of which shows a rubber hose connecting the air inlet fitting to a metal sleeve. Another prior art device which has attempted to increase the flexibility of the air valve system of an impact ground borer is shown in FIG. 8. FIG. 8 illustrates the air valve of the Ground Bullet tool manufactured by Lewin Manufacturing Company. It comprises a nylon sleeve 301, a forward metal compression hose fitting 302, a section of rubber hose 303, and rear metal compression hose fitting 304.

Applicant has learned that the structure of the tool in FIG. 8 has a short lifetime in practice. Failures appear to occur in the structure of the rear metal compression hose fitting 304 which fractures in use.

Applicant believes that the Lewin prior art tool functions so poorly in practice because of excessive flexibility resulting from the use of rubber hose 303 and the rigidity of metal compression hose fitting 304. Applicant's invention utilizes the flexible plastic material itself as the fitting between the sleeve 201 and inlet pipe 7.

Further, applicant has noted that the prior art Lewin tool suffers from erratic operation due to valve timing irregularities caused by excessive longitudinal "stretch" of hose 302. Such stretch occurs unpredictably and, hence, unpredictably alters the relationship of the valve sleeve to the body of the tool, thereby changing the timing in an irregular and undesirable fashion.

Also, applicant is aware that the Lewin tool utilizes no shock dampener such as the shock dampener 35 of the present invention. Applicant believes that the lack of such a dampener exacerbates the poor vibrational characteristics of the Lewin air valve assembly.

Applicant has also discovered that by machining one or more bearing lands 207 of about 0.0010 inch height onto the body of sleeve 201, the antifriction properties of the phenolic-impregnated linen may be taken advantage of as well as greatly reduced bearing length. Phenolic impregnated nylon additionally absorbs some lubricating oil from the pressure air stream, increasing the lubricity of the sleeve 201.

Although the prior art Lewin device shown in FIG. 8 utilized a nylon sleeve 301, no bearing lands of any kind were used in the Lewin device, rather grooves 305 were present leaving a long, continuous bearing surface in contradistinction to the short bearing surfaces of applicant's bearing lands 207.

As is readily apparent from the preceding discussion, the invention of applicant's discoveries may be utilized either singly in improving the functioning of air impact ground borers or most advantageously may be combined together to produce an air impact boring tool of superior efficiency, power and reliability.

As will be obvious to the reader, there are many potential variations and modifications possible to applicant's invention as described herein.

What is claimed as the invention is:

1. An impact-operated boring tool, comprising:

an elongated, generally cylindrical housing having a tubular inner wall;

an elongated striker lengthwise reciprocable in said housing for forward driving impacting engagement against an interior impact surface of said housing proximate the front end of said housing, said striker having a rear portion of enlarged diameter, said rear portion having an annular, outwardly opening groove therein, said striker further having a plurality of curved guiding zones proximate the front end of said striker and a flat air passage surface between, each of said guide zones have a central, outwardly opening recess therein, said striker further having a tubular wall defining a rearwardly openingly tubular recess in said striker, and a radial port disposed forwardly of said enlarged rear end portion of said striker extending through said tubular wall of said striker;

a plurality of resilient, rounded spot bearings set into said central recesses in said guide zones for sliding engagement with said tubular inner wall of said housing;

a split bearing ring fitted under compression to said tubular inner wall disposed in said annular groove in said enlarged diameter rear end portion of said striker for resilient, slidable, sealing engagement with said tubular inner wall of said housing;

a tubular inlet connectable at a rear end thereof to a pressure fluid source, said inlet having an enlarged diameter front portion closely slidably received in said tubular, rearwardly-opening recess in said striker;

passage means for reciprocating said striker in response to pressure fluid supplied through said inlet into said recess of said striker; and a support assembly for maintaining said inlet substantially concentric to said housing.

2. The tool of claim 1, wherein said tubular inlet comprises a metal pipe and a sleeve made of lubricated plastic threadedly coupled to the front end of said pipe, said sleeve having said enlarged diameter front portion formed thereon.

3. An impact-operated boring tool, comprising:

an elongated, generally cylindrical housing, an elongated striker lengthwise reciprocable in said housing for forward driving impacting engagement against in impact surface near a front end of said housing, a rigid pipe connectable at a rear end thereof to a pressure fluid source;

a support assembly connected to said rigid pipe for maintaining said pipe substantially concentric to said housing;

a unitary, flexible plastic sleeve having:

an enlarged diameter front portion which is in close, sealing, sliding contact with a coaxial rearwardly-opening recess in said striker, a rear coupling portion of lesser diameter than said front portion configured to sealingly engage a front end of said rigid pipe, a neck portion which spans said front and rear portions of said sleeve, and a lengthwise bore extending through said sleeve allowing communication between said rigid pipe and said rearwardly opening recess in said striker;

means for removably securing said plastic sleeve to said front end of said rigid pipe; and passage means for reciprocating said striker in response to pressure fluid supplied through said pipe and said plastic sleeve into said recess of said striker.

4. The tool of claim 3, wherein said sleeve securing means comprises mating threads formed on the outer surface of said front end of said rigid pipe and on the inner surface of a rear end portion of said bore.

5. The tool of claim 4, wherein said bore has a rear end portion of enlarge diameter in which said threads are formed.

6. The tool of claim 3, wherein said front portion of said sleeve has a series of spaced apart, radial bearing lands thereon which engage said rearwardly opening recess in said striker.

7. The tool of claim 5, wherein said neck portion is elongated and has a lesser diameter than both of said front and rear portions of said sleeve.

8. The tool of claim 6, wherein said bearing lands comprise a first radial land disposed at a front end of said front portion, a second radial land disposed at a rear end of said front portion, and a third radial land disposed intermediate said ends of said front portion.

9. The tool of claim 5, wherein said rigid pipe has a threaded front end portion which fits into said enlarged rear end portion of said bore, and a portion rearwardly adjacent thereto which has a larger diameter than said enlarged rear end portion of said bore.

* * * * *